US006306041B1

(12) United States Patent
Mendes, Jr.

(10) Patent No.: US 6,306,041 B1
(45) Date of Patent: Oct. 23, 2001

(54) GAMING APPARATUS HAVING VARIABLE PERFORMANCE ZONES

(75) Inventor: John F. Mendes, Jr., Ormond Beach, FL (US)

(73) Assignee: Bob's Space Racers, Inc., Daytona Beach, FL (US)

( * ) Notice: Subject to any disclaimer, the term of this patent is extended or adjusted under 35 U.S.C. 154(b) by 0 days.

(21) Appl. No.: 09/527,922

(22) Filed: Mar. 17, 2000

Related U.S. Application Data

(63) Continuation-in-part of application No. 09/506,678, filed on Feb. 17, 2000, which is a continuation of application No. 09/426,039, filed on Oct. 25, 1999.

(60) Provisional application No. 60/106,225, filed on Oct. 30, 1998.

(51) Int. Cl.[7] ..... H63F 9/14

(52) U.S. Cl. ..... 463/59; 273/442

(58) Field of Search ..... 273/441, 442, 273/445, 454, 459, 460; 463/58, 59, 60, 62, 63

(56) References Cited

U.S. PATENT DOCUMENTS

| | | | |
|---|---|---|---|
| 4,335,878 | 6/1982 | Nishimiya | 273/26 |
| 5,066,014 | 11/1991 | Dobson | 273/110 |
| 5,407,212 | 4/1995 | Dobson | 273/446 |
| 5,439,230 | 8/1995 | Mendes, Jr. et al. | 273/349 |
| 5,566,950 | 10/1996 | Senna | 463/60 |
| 5,573,243 | 11/1996 | Bartosik | 463/60 |
| 5,667,217 | 9/1997 | Kelly et al. | 273/126 R |
| 5,669,607 | 9/1997 | Silver et al. | 273/354 |
| 5,678,823 | 10/1997 | Chaffee et al. | 273/371 |
| 5,954,338 | 9/1999 | Hampton | 273/349 |

*Primary Examiner*—Raleigh W. Chiu
(74) *Attorney, Agent, or Firm*—Standley & Gilcrest LLP

(57) ABSTRACT

An arcade-style racing game is described. The game preferably includes a gaming surface, an actuator, a first feedback device, a game piece, a steering mechanism, a second feedback device, and a processor. A racing track may be depicted on the gaming surface. An actuator is preferably adapted to rotate the surface about an axis on command. The game piece is preferably positioned substantially adjacent to the surface. The steering mechanism is preferably indirectly connected to the game piece, and it may be adapted to move or rotate the game piece over a predetermined range. With use of the steering mechanism, a game player may position the game piece near the center of the racing track as the surface rotates about the central axis. A player's performance may be determined fractionally by continually determining the rotational position of the track and the lateral position of the game piece. An award or number of points given to a player of the game may preferably vary based upon the ability of the player to maintain the game piece near the center of the track. A group competition game is also disclosed in which a secondary monitor displays each player's progress as each player steers his or her respective game piece.

20 Claims, 9 Drawing Sheets

GAMING APPARATUS HAVING VARIABLE PERFORMANCE ZONES

This application is a continuation-in-part application of continuation-in-part application Ser. No. filed 09/506,678 Feb. 17, 2000, which is a con't of application Ser. No. 09/426,039 filed Oct. 25, 1999, which claims the benefit of U.S. Provisional Application No. 60/106,225, filed Oct. 30, 1998.

BACKGROUND AND SUMMARY OF THE INVENTION

The present invention relates generally to gaming apparatus useful in arcade-style games. In the past, arcade-style games have been simple in nature and directed primarily at children. In one such game, where the object is to maneuver a car-shaped game piece on a rotating surface, children are offered a chance to simulate driving, attempting to keep the car inside the boundaries of a track painted on a rotating surface. The child is then rewarded with points, tickets, or other indicia of success, the amount of which may depend upon how long the child is able to keep the car within the boundaries of the track. These games generally fall into two main categories: skill games and competition games. In a skill game, a player is generally pitted against a task, such as keeping a car within track boundaries or shooting at a target, and rewarded based upon the performance of that task. In a competition game, multiple players are primarily pitted against each other and rewarded based upon the relative performance of each player. The relative performance may be determined by simultaneous play or by competing against another player's score or performance.

Recently, commercial places of amusement such as restaurants with arcades and large game facilities have become more prevalent. These facilities may cater to adults as well as children, or perhaps primarily just adults. As such, there is a demand for games involving a higher level of skill. Presently, arcade-style games utilize switches or on/off sensors to determine success or failure. Some games use multiple sensors to account for different levels of success. There is presently, however, no technology for measuring fractional success.

It is therefore an object of the present invention to provide arcade-style games which offer a greater challenge and reward players more in accordance with their particular performance in the game by measuring a player's fractional success.

The present invention includes gaming apparatus, gaming devices, and gaming systems. The present invention may also be used to upgrade or retrofit existing devices or apparatus, using methods and components described herein or known in the art.

A preferred embodiment of a game of the present invention comprises gaming apparatus supported by a base structure. A player controlled device, such as a steering mechanism, firing mechanism, joystick, buttons, or other game controller device now known or subsequently developed, is used to allow a user to play the game. A feedback device is placed in communication with the player-controlled device. The feedback device may be any appropriate feedback device capable of measuring fractional performance, such as a potentiometer, encoder, or other measurement device known in the art. A processor is then utilized to receive a signal or input from the feedback device. The processor then determines the fractional performance of the player in the game. The game may also include an indicator of performance in communication with the processor, such as a display device, award dispenser, or sound-producing device. The game may use a second feedback device in communication with the gaming apparatus. This second feedback device may then provide additional signal data that the processor may use to determine performance.

Also included in the present invention is a game comprising a gaming surface, the surface supported by a base structure. An actuator is connected to the gaming surface, adapted to rotate the surface about an axis. A first feedback device in communication with the actuator is adapted to determine the rotational position of the surface. A game piece is positioned substantially adjacent to the surface. This game piece may be adapted to remain substantially stationary with respect to longitudinal movement along the rotating gaming surface. A steering mechanism is connected to the game piece, adapted to enable rotation or movement of the game piece over a range of the racing surface. A second feedback device is also used, adapted to determine the lateral position of the game piece relative to the track surface. A processor is then used to receive signals or other input from the first and second feedback devices and determine the fractional performance of a player of the game.

The actuator may be adapted to rotate the gaming surface at a constant speed, or may vary the speed based on the performance of a player. The actuator may increase the speed of surface rotation when the player moves the position of the game piece toward a preferred region of the gaming surface. The actuator may rotate the surface a predetermined amount of time, or may rotate the surface for a time period that varies based upon the performance of the player. The game may have an award dispenser connected to the base structure. The award dispenser may dispense a fixed award to each player, or distribute an award that varies based upon the performance of a player. The player steering mechanism of the game preferably includes a steering wheel that is indirectly connected to the player's game piece, such that as the steering wheel is turned the game piece responds accordingly. The game may also have an indicator of progress that may advance along a predetermined path toward a destination as the game is played. The gaming surface may indicate any appropriate gaming situation, such as a race track, river, or roadway.

The present invention also comprises a competition game having at least two gaming surfaces, each surface having an appropriate gaming surface depicted upon it, such as a racing track, river, or roadway. The game utilizes an actuator for each surface, each actuator adapted to rotate an attached surface about a respective axis. A first feedback device is connected to each actuator, each first feedback device adapted to determine the rotational position of the respective surface. There is a game piece for each surface, the game piece positioned substantially adjacent to its respective surface.

Each surface also has a respective steering mechanism. The steering mechanism may be connected either directly or indirectly to a respective game piece, and adapted to enable movement of the game piece over a range of the surface. A second feedback device is utilized for each steering mechanism, the second feedback device adapted to determine the lateral position of the respective game piece relative to the respective gaming surface. A processor is then used to receive signals or input from the first and second feedback devices for each gaming surface and determine the fractional performance of a player at any or all of the gaming surfaces. The game may additionally include an indicator of progress for each surface, adapted to advance along a predetermined path toward a destination when a player maintains a respective game piece within certain boundaries of the respective gaming surface. The game may end when one of the indicators reaches its destination.

In addition to the novel features and advantages mentioned above, other objects and advantages of the present invention will be readily apparent from the following descriptions of the drawings and preferred embodiments.

DETAILED DESCRIPTION OF PREFERRED EMBODIMENT(S)

Figure 1:
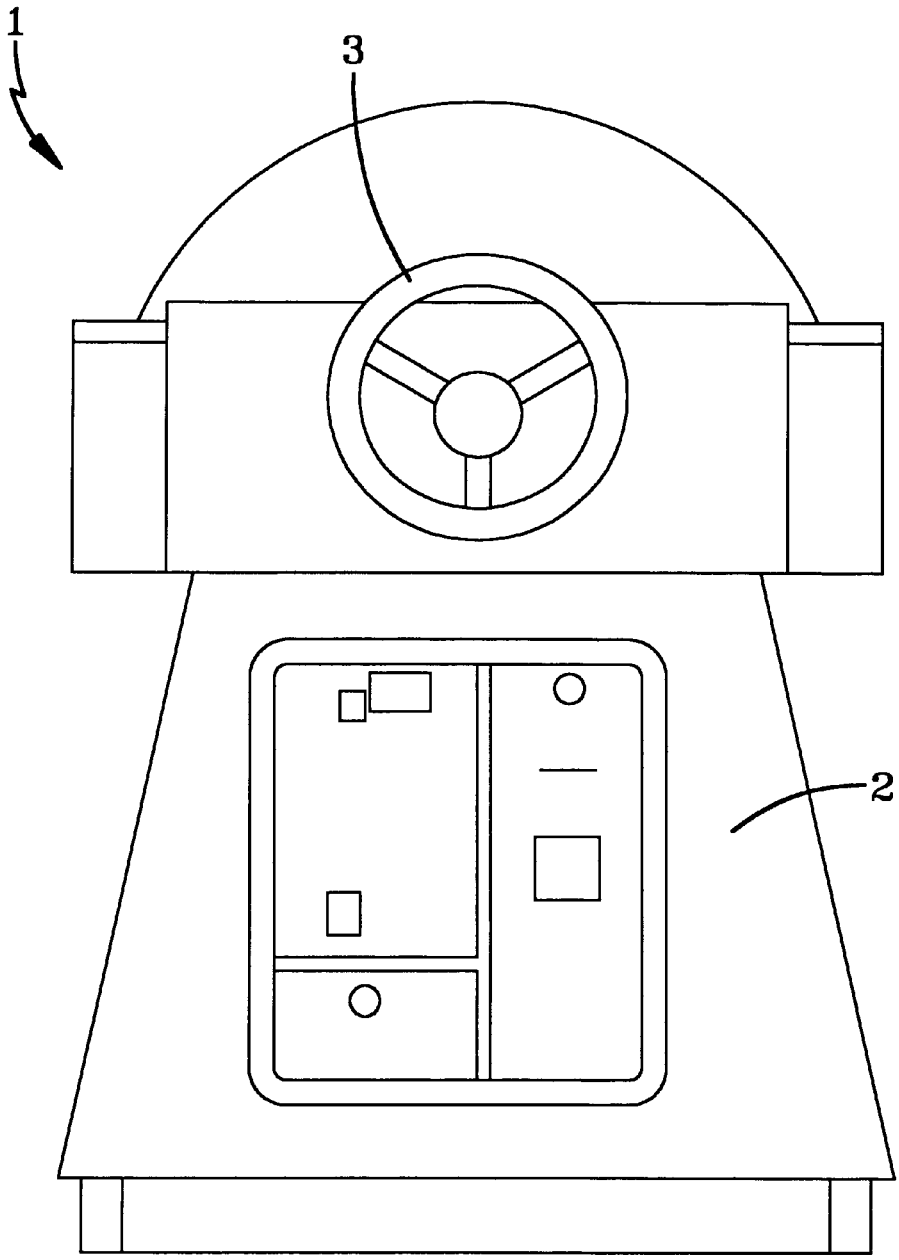
FIG. 1 is a front elevation view of a preferred embodiment of a game of the present invention.
Figure 2:
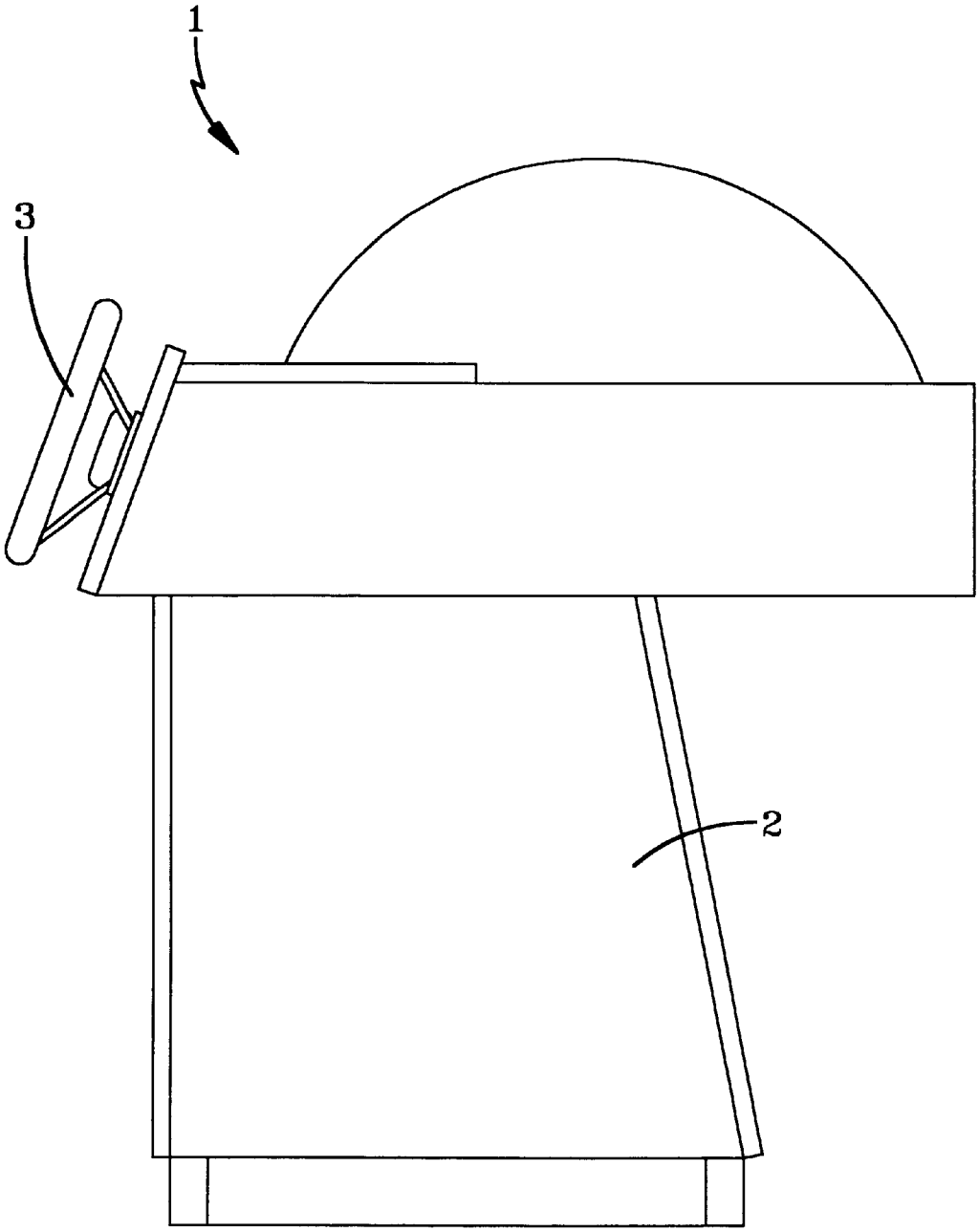
FIG. 2 is a side elevation view of the game shown in FIG. 1.
Figure 3:
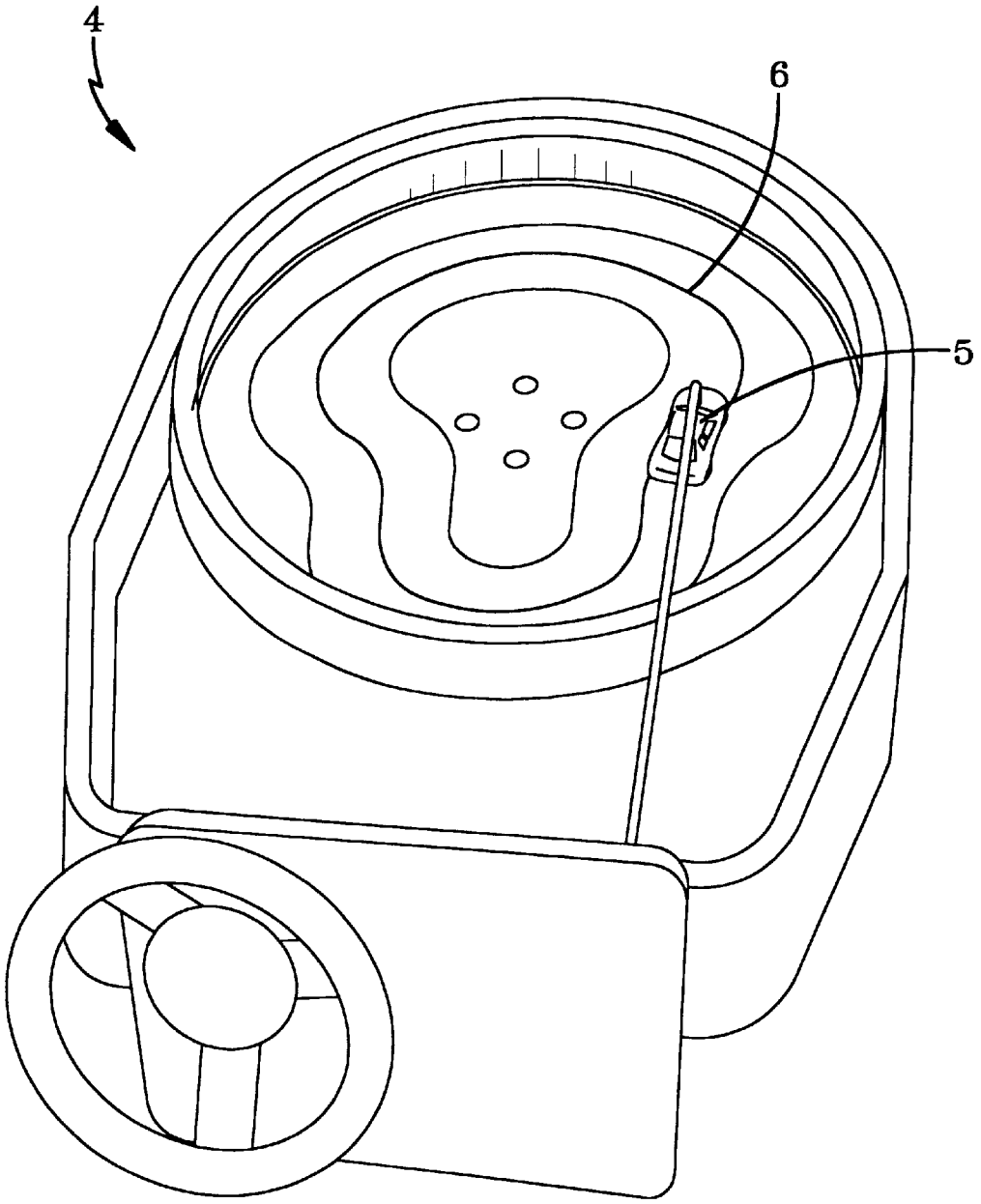
FIG. 3 is a pictorial view of a preferred embodiment of a game of the present invention.

The present invention is directed to gaming apparatus having variable performance zones or measuring fractional performance. FIGS. 1 and 2 show one embodiment of a game 1 of the present invention. A preferred embodiment of a game of the present invention includes a base structure 2, a track surface, an actuator, a first feedback device, a game piece, a steering mechanism 3, and a second feedback device. A racing track may be depicted on the track surface. The racing track may be depicted by any suitable means such as paint. It is preferred that the racing track be substantially flat, although those skilled in the art should recognize that the racing track may have undulations. FIG. 3 shows a game piece 5 on the track surface 6 of a preferred game 4 of the present invention.

There is preferably a central region of the track 6 that is associated with the highest level of skill, a region on each side of the central region which represents intermediate levels of skill, and an outer region representing the lowest level of skill. The regions preferably run along the track 6. When a game piece 5 is located completely within the central region, the player is rewarded with the highest performance bonus. As the game piece 5 leaves the central region and enters the intermediate zones of skill, the performance bonus decreases fractionally as the game piece moves laterally away from the center of the track 6. The performance bonus decreases until the game piece 5 is located completely within the outer region of the track 6, when the performance bonus is at a minimum or no performance bonus is given. Performance may be based upon skill regions of fixed width or upon a continuous skill function. Those skilled in the art should recognize that the racing track may have obstacles, bonus areas, or other regions which would represent regions of higher or lower skill.

An actuator may be adapted to rotate the surface about a central axis on command. The actuator may comprise a stepper motor. A stepper motor preferably facilitates measurement and/or control of how far the surface has rotated about the central axis. Feedback from the stepper motor or other associated device may then be used as input for software calculations. The game piece 5 is preferably positioned substantially adjacent to the surface. The game piece may be in practically any desired form such as a representation of a car, space ship, horse, dog, or other object now known or subsequently created or discovered.

The steering mechanism is preferably indirectly yet mechanically or electronically connected to the game piece, and is adapted to move or rotate the game piece through a predetermined range on the track. The steering mechanism preferably includes a steering wheel, but may include a joystick, paddle, gun, mallet, or any other appropriate gaming device. By using the steering mechanism, a game player may position his or her game piece substantially within the boundaries of the racing track as the surface rotates about the central axis. The steering wheel is preferably attached to a rod which moves the game piece laterally across the track surface. The steering mechanism position, which translates into the relative lateral position of the game piece, may be picked up by a potentiometer, encoder, or other feedback device. This position may be used as a second input for software calculations. The software may calculate the game piece position from the two inputs. The position is then preferably compared to the known position of the track center. Based on the result, instructions are then preferably sent to control the performance indicator. Because performance control is generated by software instead of hardware, game difficulty may be modified by a software program change instead of moving or installing sensors. Games may be programmed to accommodate different skill levels for children or adults.

Figure 5:
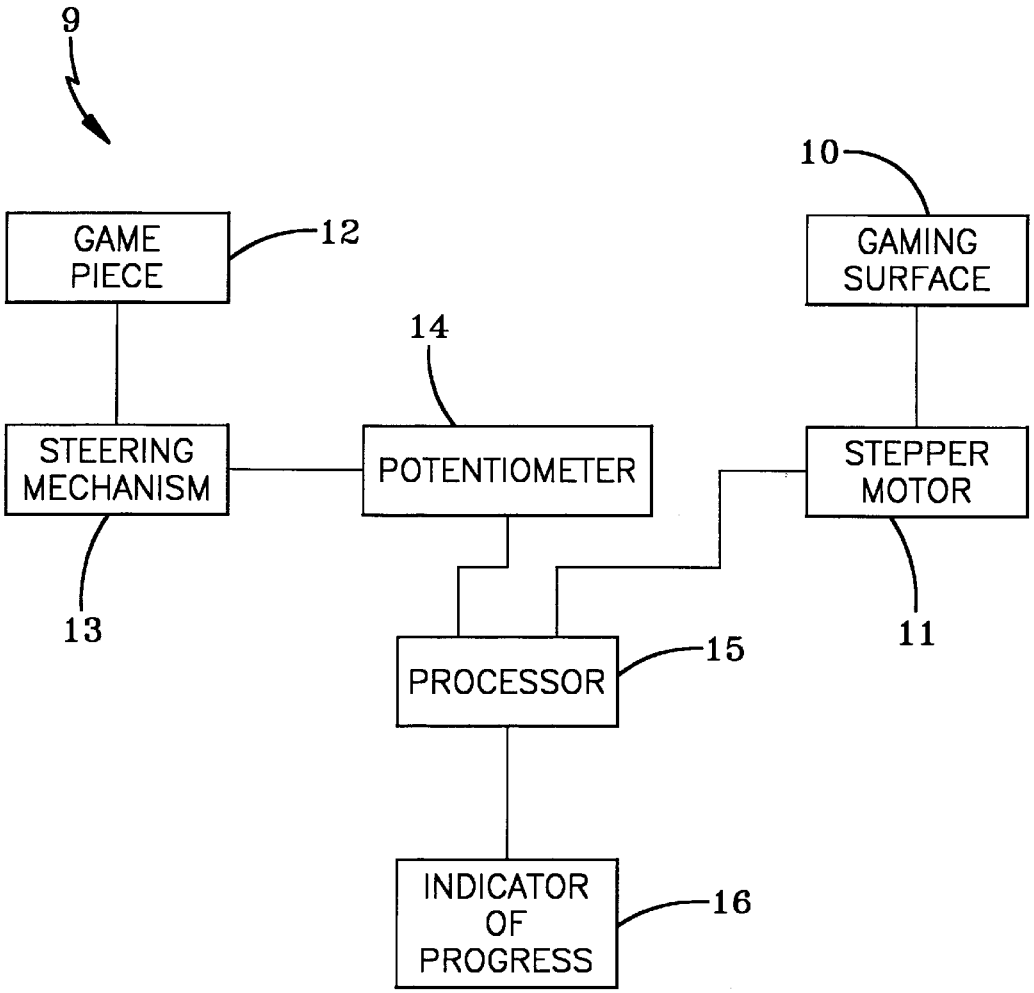
FIG. 5 is a schematic diagram of a game of the present invention.

A schematic 9 of a preferred embodiment of the present invention is shown in FIG. 5. In this embodiment, the gaming surface 10 is mechanically connected to a rotation-capable device, in this case a stepper motor 11. The mechanical connection may be any appropriate connection, such as a mechanical linkage or a direct affixation of the gaming surface to the drive axis of the stepper motor. The stepper motor 11 is electronically connected to a game processor 15. The processor 15 sends appropriate signals, such as stepped voltage signals, to the stepper motor 11 as a drive input, thereby controlling the movement of the stepper motor drive axis and the attached gaming surface 10. As software providing instructions for the processor controls the movement of the stepper motor, the software is preferably capable of knowing at any time the rotational position of the gaming surface. The game may also be adapted to have a signal sent back from the stepper motor to the processor giving position information.

A steering mechanism 13, such as a steering wheel, is mechanically connected to a feedback device, such as a potentiometer 14. The steering mechanism 14 is also mechanically connected to a game piece 12 near the gaming surface 10. The steering mechanism 13 may be attached to a central axis of the potentiometer 14. As the steering mechanism 13 is rotated, the axis of the potentiometer is similarly rotated, thereby changing the voltage output of the potentiometer 14. This voltage is then input to the processor 15 and used to determine rotational position.

The processor 15 may then use the signal from the potentiometer 14 together with the stepper motor position information to determine the performance of a person playing the game. The potentiometer is preferably highly sensitive, such that small movements in the steering mechanism may be detected and measured by the processor. These small changes then preferably result in a more accurate measurement of performance. This fractional or highly sensitive measurement of performance is one main advantage of the present invention over the prior art. Since software is used to determine performance from position information, the difficulty of the game may be altered by simply uploading new instructions or software to the processor, with no change in hardware required. This also allows the placing of bonus zones or regions of differing performance placed along the gaming surface 10. An indicator of progress 39 may then also be used, adapted to receive a signal from the processor. The indicator may be any appropriate indicator known in the art, such as a digital display, ticket dispenser, or audio indicator. In different embodiments, the indicator may, based upon performance, display points or distance measurements, dispense differing numbers of tickets, or may emit sounds indicating higher or lower revving motors.

Figure 6:
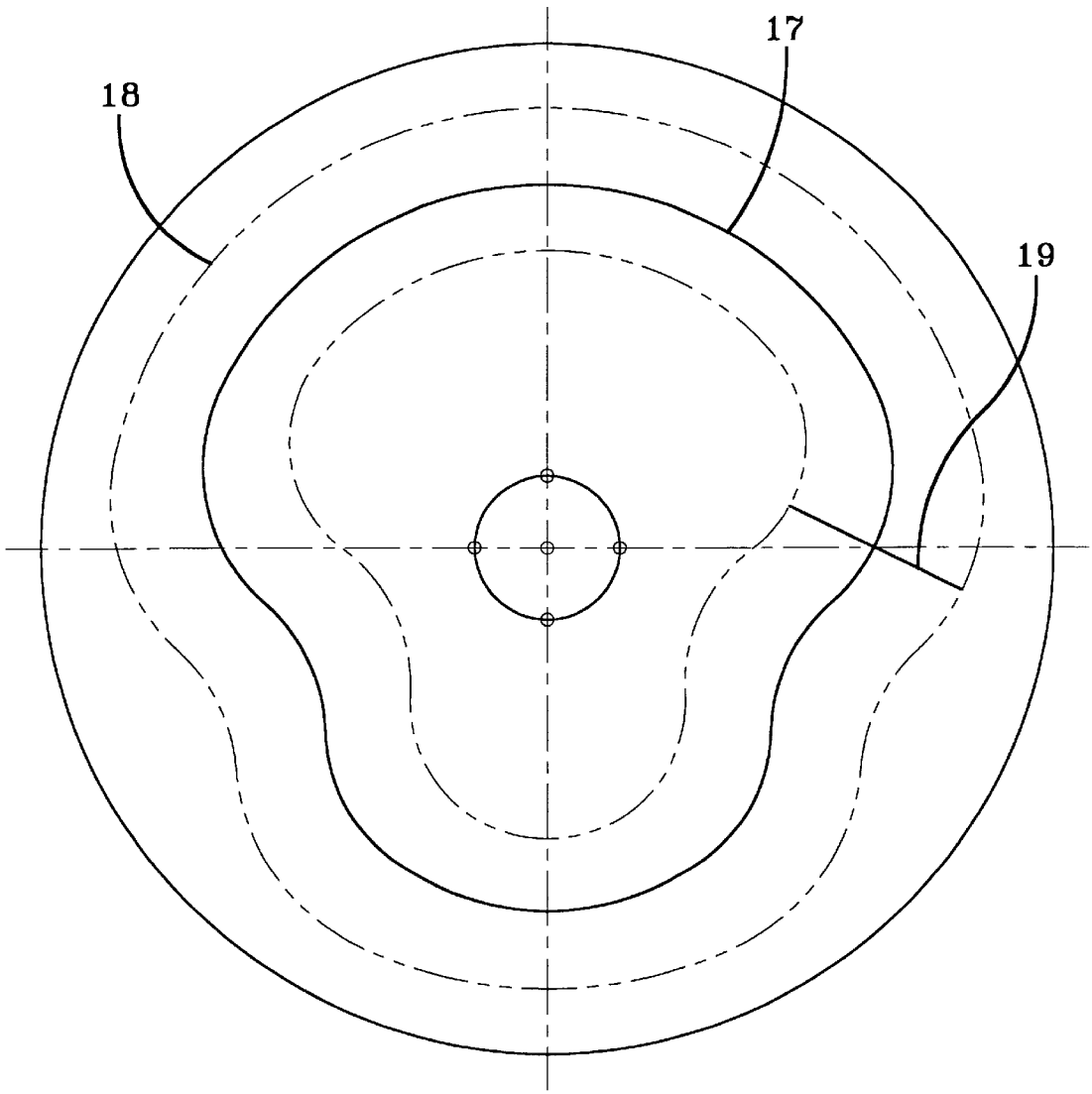
FIG. 6 is a top view of a gaming surface of the present invention.
Figure 7:
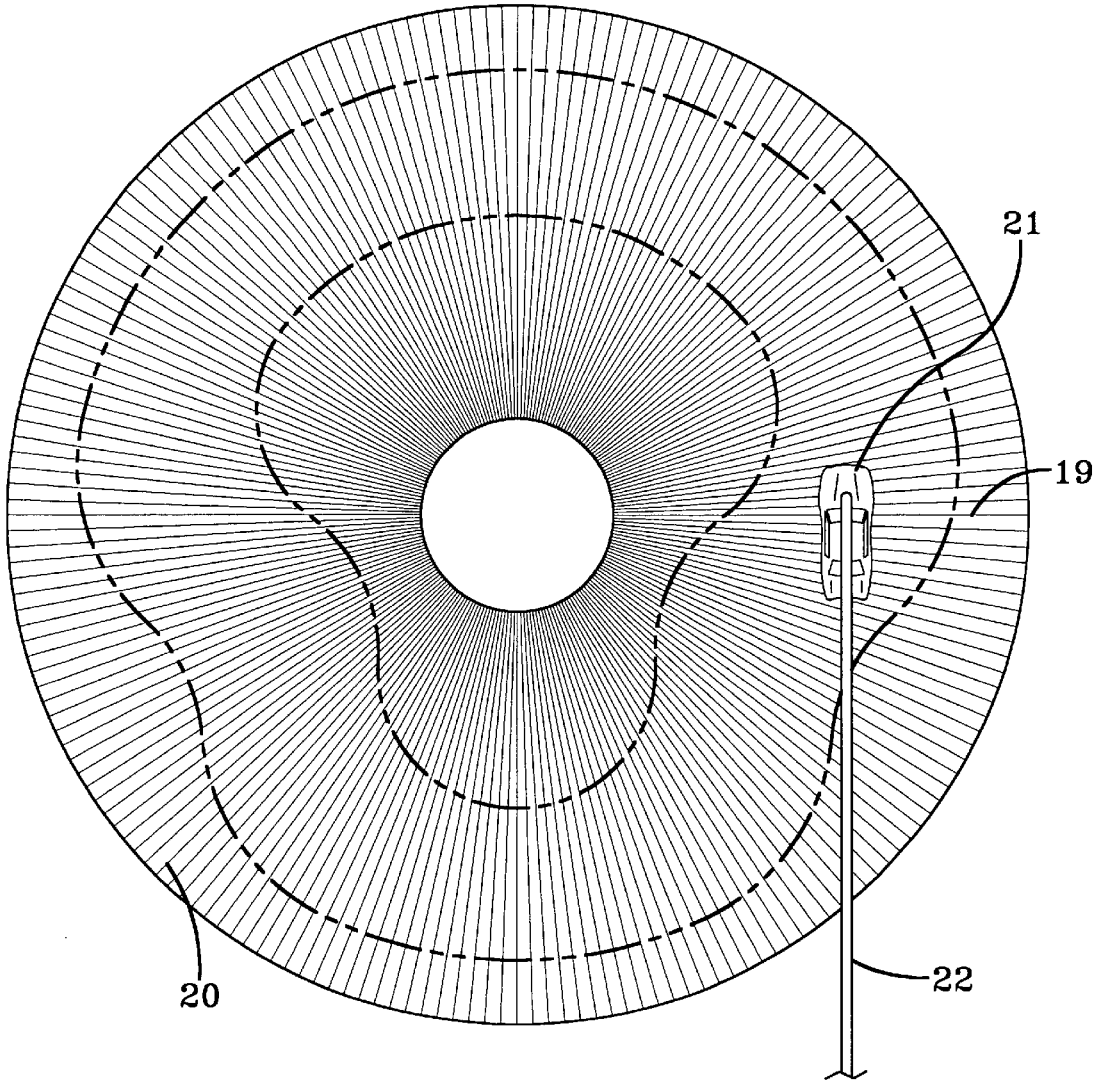
FIG. 7 is another top view of the gaming surface in FIG. 6.

FIGS. 6 and 7 illustrate top plan views of a track used with one embodiment of the game of the present invention. The outline of the track of FIG. 6 illustrates a centerline 17, start position 19, and boundary 18. FIG. 7 illustrates the same track of FIG. 6, distinguished by a series of lines 20 superimposed over the table or surface. The lines are drawn from the center point, or origin, of the table to the outer edges. These lines 20, or radials, do not appear on the game itself but are used for game programmers.

As the game surface rotates, the motor and game program may constantly track the degrees the surface has rotated. Therefore, the number of degrees the surface has rotated from a start position 19 is tracked and stored. In one embodiment, sensor technology is used to detect the degrees the surface has turned. In an alternate embodiment, a stepper motor is calibrated so that the degrees the surface has turned can be determined from the stepper motor function. The game, via programming, knows by determining how many degrees the surface rotates, which radial 20 is aligned with the fixed starting point 19. In a preferred embodiment, a magnetic sensor attached to an edge of the table is used to return the table to the starting point at the end or start of every race). In FIG. 7 there are 200 radials 20 (the number of radials 20 may be increased for greater accuracy.

As an example, assume radial 1 is aligned with the fixed starting point 19. In one embodiment, if the surface rotates 90 degrees, radial 50 would be aligned with the fixed starting point 19. This first coordinate value, or radial value, is one of the coordinates required to locate the relative position of the game piece 21 on the surface of the table.

A second coordinate value is determined by the game piece 21 along its axis as the game piece 21 is moved in the left and right direction, left and right being determined from a reference point facing the steering wheel of the game. The game piece 21 is preferably connected to a connecting rod 22 at a single point. In the preferred embodiment, the rod 22 is attached at the other end to a gear and steering wheel. As the steering wheel rotates, the rod 22 moves the game piece 21 between a left-most position and a right-most position on the game surface. In one embodiment, the rotation of the steering wheel is measured by a sensing device, which is then stored as the second coordinate value (i.e., game piece position value). In another embodiment, game piece position values are determined by connecting the steering mechanism with a potentiometer. By measuring the resistance value or current through the potentiometer, the game can determine the location of the game piece over the game surface. In a preferred embodiment, the game is calibrated to allow the game piece 21 to move in a range of preset values divided into 256 positions from 0 to 255 (more positions can be added for greater accuracy).

The radial and game piece position values or coordinates are determined by the game system and processing equipment as the table surface rotates during game play. These collected values are preferably compared to stored values. In one embodiment of the game, the absolute position of the game piece from 0 to 255 is used. In another embodiment, the lateral distance traveled from a known start position may be used. Accordingly, the table centerline and/or boundary position can be programmed for each radial value.

In operation, the data for determining performance preferably includes the radial value, the centerline position (and/or boundary position) value for that radial, and the game piece position value. As the table surface turns, the radial value is continuously determined. Using the radial value, the desired centerline 17 or boundary positions are determined. The actual game piece position value is determined by movement of the steering wheel. The system continuously calculates the difference between a desired position value for each radial value (e.g., centerline position value) and the actual game piece position value. If the difference between the values is small, the game player is maintaining the game piece 21 relatively close to the desired value. Similarly, the game may track when the game piece moves outside the boundary position values for each radial.

In one embodiment of the present invention, the game player may only be able to rotate (or turn) the game piece a predetermined range about an axis within the game piece. In other preferred embodiments, the game player may be able to use the steering mechanism to laterally move the axis of rotation of the game piece, as well as move the game piece about the axis.

The game may last for a fixed or variable period of time. For example, the actuator may only be adapted to rotate the surface for a predetermined time in some embodiments. In other embodiments, the actuator may be adapted to rotate the surface for a time period that varies based on the performance of the game player. For instance, the game may last longer if the game player is performing well (i.e., maintaining the game piece near the track center).

Figure 4:
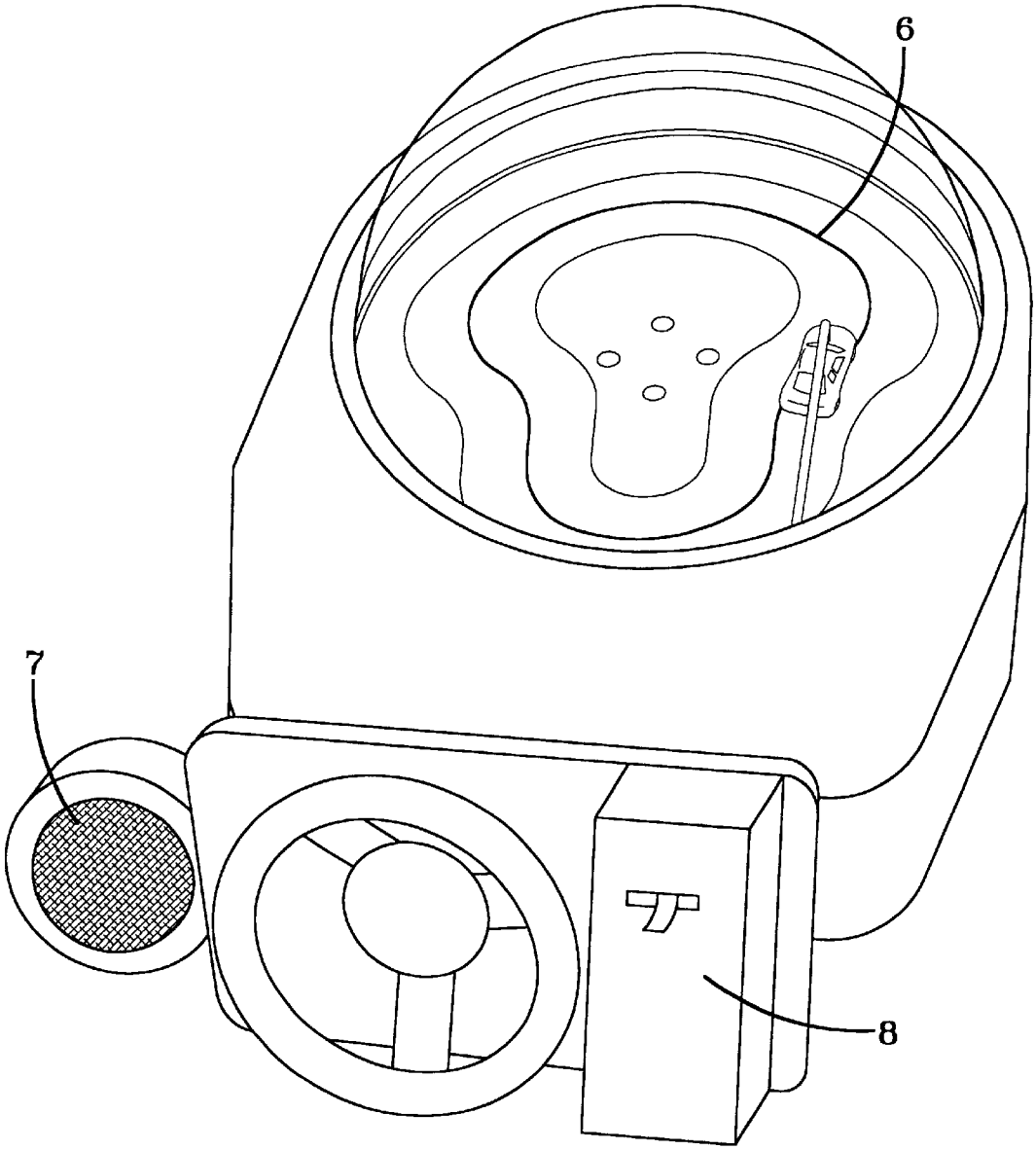
FIG. 4 is a pictorial view of a preferred embodiment of a game of the present invention.

The game may include an award dispenser 8 as shown in FIG. 4. The award dispenser 8 may be practically any conventional award dispenser known to those of ordinary skill in the art. The award dispenser may distribute items such as tickets, coupons, tokens, or other types of prizes or awards. In some embodiments of the invention, the award dispenser may only distribute a fixed award regardless of how well or poorly the game player performs. In other embodiments, the award dispenser may distribute awards that vary based upon the performance of the game player. The game of the present invention may further include audio and/or visual indications of the progress of the game. For example, audio speakers 7 may be electronically connected to the actuator and a pre-programmed sound card to produce racing-related sounds during game play.

The game may include a secondary indicator of progress. The secondary indicator of progress may be adapted to advance along a predetermined path of a secondary monitor, toward a destination. The game may end when the indicator of progress reaches the destination. In some embodiments of the invention, the indicator of progress may advance to the destination on the secondary monitor at a fixed speed while the player steers his or her game piece within predetermined boundaries along the surface.

Figure 8:
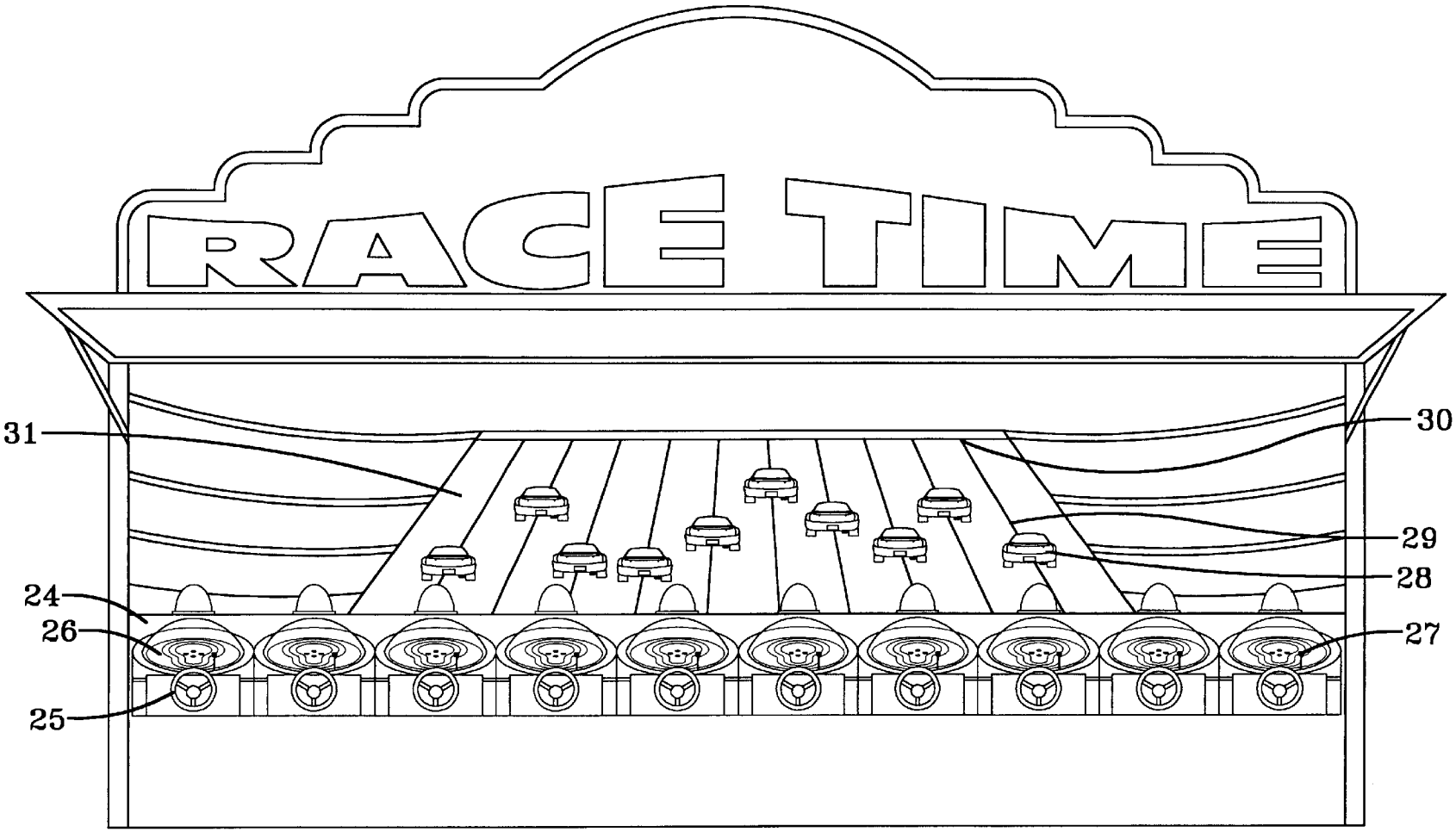
FIG. 8 is a side elevation view of a preferred embodiment of a game of the present invention.

If a game player is racing against other game players in a group game, as shown in FIG. 8, each game player may have his or her own indicator of progress 28 displayed on a secondary monitor 31. In such cases, the game may end when the first indicator of progress 28 in the group reaches its predetermined destination. With regard to a game player racing against at least one other game player, it should be recognized that the game may have more than one game piece on the same racing track 26 so that the game players may race on the same track 26. For example, the racing track may have a plurality of lanes. Each of the lanes may rotate independently of the other lanes. In such embodiments, the game preferably has a separate actuator for each lane. The game may be designed such that each player races in a separate lane. If a player's game piece crosses over into another's lane, that player's lane or game piece may slow down relative to the other player's lane or game piece. Similarly, if a player maintains his game piece within his lane, his lane or game piece may speed up or maintain a top speed relative to the other player's lane or game piece.

A preferred embodiment of a game of the present invention may include a plurality of surfaces 24, a plurality of actuators, a plurality of first feedback devices, a plurality of game pieces 27, a plurality of steering mechanisms 25, a plurality of second feedback devices, and a plurality of indicators of progress 28. Each of the surfaces may have a racing track 26 depicted thereon. Each of the actuators is preferably adapted to rotate a respective one of the surfaces about a respective central axis on command. Each game piece may be positioned substantially adjacent to a respective one of the surfaces. It is preferred that each steering mechanism is connected to a respective one of the game pieces, and each steering mechanism may be adapted to move a respective one of the game pieces over a predetermined range. Skill regions preferably run along the track. When a game piece is located near the lateral center of the track, the player is rewarded with the highest performance bonus. As the game piece enters intermediate zones of skill, or moves away from the track center, the performance bonus decreases fractionally. The performance bonus decreases until the game piece is located completely within the outer region of the track, when the performance bonus is at a minimum or no performance bonus is given. Those skilled in the art should recognize that the racing game may have regions positioned in different areas throughout the surface.

Figure 9:
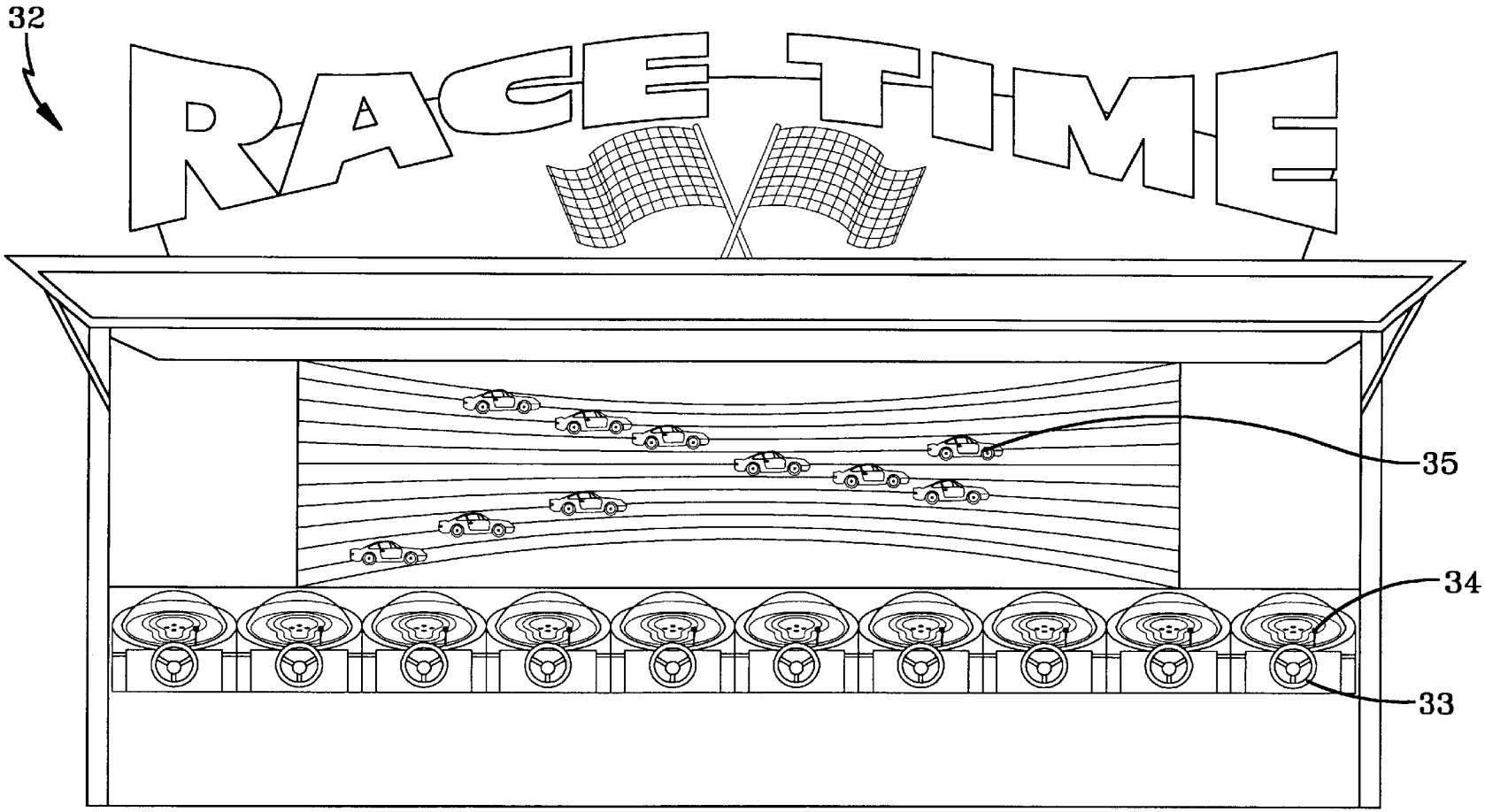
FIG. 9 is a side elevation view of another preferred embodiment of a game of the present invention.

Each indicator of progress 30 may be adapted to advance along a respective predetermined path 29 on a secondary monitor 31 to a respective destination 30. In such an embodiment, a plurality of game players may play the game simultaneously. Each game player controls the position of that player's game piece 27 on track 26, and as each player succeeds in maintaining his or her game piece 27 near the lateral center of the track 26, each player's driving success is displayed on the secondary monitor 31 via indicator 28 moving further along path 29 at a fixed speed, the indicator moving when the player keeps his or her game piece substantially within predetermined boundaries. Furthermore, the game may end and a winner may be declared when a first one of the indicia of advancement 28 reaches its predetermined destination 30. Another embodiment of a competition game 32 is shown in FIG. 9, showing another configuration of the steering devices 33, racing tracks 34, and secondary monitor 35.

The game of the present invention may further include audio and/or visual indications of the progress of the game. For example, audio speakers may be electronically connected to the actuator and a pre-programmed sound card to produce a car crash sound if a player's game piece leaves the track. The pre-programmed sound card may also produce different engine noises depending on the skill region occupied by a player's game piece. In another embodiment, bright lights may flash when a first player's indicator of progress reaches its destination. Alone or in association with the bright lights, a loud siren may sound indicating that a player's indicia of advancement is the first to reach its destination.

Although described with respect to racing games, it should be obvious to one skilled in the art that the advantages of the present invention, including fractional performance determination, may obtain in other gaming apparatus as well. For example, in a shooting game, it might be desirable to determine how closely a player can get to a target, not just whether or not the player hits the target. Such determination could be made by monitoring the contact of a projectile with a target sensor or plurality of sensors, or by monitoring the position and direction of the firing apparatus when the trigger or firing mechanism is depressed. An advanced game might use information from both sources to get a more accurate result.

In a game where the task may be to achieve a number or goals, such as shooting a number of objects or directing a car or boat over a number of obstacles, it may be desirable to allow players to catch up when they get behind. In a racing game using current technology, once a player falls behind that player may have no opportunity to catch up. If a player improves performance during a game, the current technology would allow that player to catch up by increasing point totals or advancing indicia of progress at greater intervals by monitoring and rewarding the fractional performance of the players. For example, in an arcade game where a player attempts to shoot a basketball through a basket as many times as possible in a given period of time, that player may get rewarded more points for ten shots made in a one-minute interval than ten shots made in a two minute interval. This allows a player who might miss a few shots at the beginning an opportunity to catch another player who started off more strongly.

The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A game comprising:

(a) a base structure;

(b) gaming apparatus supported by said base structure;

(c) a player-controlled device in communication with said gaming apparatus;

(d) a feedback device in communication with said player-controlled device, said feedback device adapted to monitor said player-controlled device; and (e) a processor in communication with said feedback device, said processor adapted to receive a signal from said feedback device and determine the fractional performance of a player of said game.

2. The game of claim 1 additionally comprising an indicator of performance in communication with said processor.

3. The game of claim 2 wherein said indicator of performance is selected from the group consisting of display devices, award dispensers, and sound-producing devices.

4. The game of claim 1 additionally comprising a second feedback device in communication with said gaming apparatus, said processor additionally adapted to monitor said second feedback device for use in said determination of fractional performance.

5. A game comprising:

(a) a plurality of gaming surfaces;

(b) a plurality of actuators, each of said actuators adapted to rotate a respective one of said gaming surfaces about a respective central axis on command;

(c) a plurality of first feedback devices, each of said first feedback devices in communication with a respective one of said actuators and adapted to determine the rotational position of a respective one of said gaming surfaces;

(d) a plurality of game pieces, each game piece positioned substantially adjacent to a respective one of said gaming surfaces;

(e) a plurality of steering mechanisms, each steering mechanism connected to a respective one of said game pieces, each steering mechanism adapted to enable movement of a respective one of said game pieces over a range of a respective one of said gaming surfaces;

(f) a plurality of second feedback devices, each of said second feedback devices in communication with a respective one of said steering mechanisms and adapted to determine the lateral position of a respective one of said game pieces relative to a respective one of said surfaces; and (g) at least one processor in communication with said plurality of first feedback devices and said plurality of second feedback devices, said processor adapted to determine fractional performance of a player at each said gaming surface in said game.

6. The game of claim 5 additionally comprising a plurality of indicators of progress, each of said indicators of progress adapted to advance along a respective predetermined path on a secondary monitor at a fixed rate, said advancement determined by the lateral position of a respective one of said game pieces relative to a respective one of said surfaces.

7. The game of claim 5 wherein said game ends when one of said indicators of progress reaches its respective destination.

8. A game comprising:

(a) a base structure;

(b) a surface supported by said base structure, said surface indicating a gaming surface;

(c) an actuator adapted to rotate said gaming surface about an axis;

(d) a first feedback device in communication with said actuator, said first feedback device adapted to determine the rotational position of said gaming surface;

(e) a game piece positioned substantially adjacent to said gaming surface;

(f) a steering mechanism connected to said game piece, said steering mechanism adapted to enable movement of said game piece over a range of said gaming surface;

(g) a second feedback device in communication with said steering mechanism, said second feedback device adapted determine the lateral position of said game piece relative to said surface; and (h) a processor in communication with said first feedback device and said second feedback device, said processor adapted to determine fractional performance in said game.

9. The game of claim 8 wherein said actuator is adapted to rotate said gaming surface at a constant speed.

10. The game of claim 8 wherein said actuator is adapted to rotate said gaming surface at speeds which vary based on the performance of said game player.

11. The game of claim 10 wherein said actuator is adapted to increase the speed at which said gaming surface is rotated as said game player moves the position of said game piece toward a preferred region of said gaming surface as said gaming surface rotates about said central axis.

12. The game of claim 8 wherein said actuator is adapted to rotate said gaming surface for a predetermined time.

13. The game of claim 8 wherein said actuator is adapted to rotate said gaming surface for a time period that varies based on the performance of said game player.

14. The game of claim 8 further comprising an award dispenser connected to said base structure.

15. The game of claim 14 wherein said award dispenser distributes a fixed award.

16. The game of claim 14 wherein said award dispenser distributes awards which vary based on the performance of said game player.

17. The game of claim 8 wherein said steering mechanism includes a steering wheel.

18. The game of claim 8 further comprising an indicator of progress adapted to advance along a predetermined path of a secondary monitor as said game is played.

19. The game of claim 8 wherein said game piece is adapted to remain substantially stationary with respect to longitudinal movement along said surface.

20. The game of claim 8 wherein said gaming surface indicates a racing track.

* * * * *